US008006869B2

(12) United States Patent
Iizuka

(10) Patent No.: US 8,006,869 B2
(45) Date of Patent: Aug. 30, 2011

(54) FOAM DISPENSING DEVICE

(75) Inventor: Shigeo Iizuka, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 17 days.

(21) Appl. No.: 11/919,345

(22) PCT Filed: Aug. 11, 2006

(86) PCT No.: PCT/JP2006/315943

§ 371 (c)(1),
(2), (4) Date: Nov. 14, 2007

(87) PCT Pub. No.: WO2007/020891

PCT Pub. Date: Feb. 22, 2007

(65) Prior Publication Data

US 2009/0266846 A1 Oct. 29, 2009

(30) Foreign Application Priority Data

Aug. 16, 2005 (JP) ..... 2005-235937

(51) Int. Cl.
*B67D 7/76* (2010.01)

(52) U.S. Cl. ..... 222/190; 222/231.7

(58) Field of Classification Search ..... 222/109, 222/190, 321.1–321.9, 340, 341, 384, 385, 222/153.13, 383.1; 239/333
See application file for complete search history.

(56) References Cited

FOREIGN PATENT DOCUMENTS

| | | | |
|---|---|---|---|
| JP | A-7-867 | | 1/1995 |
| JP | A-07-315463 | | 12/1995 |
| JP | 2001-39460 | * | 2/2001 |
| JP | A-2002-102753 | | 4/2002 |
| JP | A-2004-121898 | | 4/2004 |
| JP | 2004-352333 | * | 12/2004 |
| JP | 2005-103425 | * | 4/2005 |
| JP | A-2005-193972 | | 7/2005 |

* cited by examiner

*Primary Examiner* — Lien T Ngo

(74) *Attorney, Agent, or Firm* — Oliff & Berridge, PLC

(57) ABSTRACT

A foam dispensing device is provided which can prevent water from entering without disturbing an introduction of outer air. The foam dispensing device includes a base cap with a hollow neck portion mounted on a mouth portion of a container; a pump suspended from a lower face of the base cap having two discharge channels for suctioning, pressurizing and discharging a content in the container and the outer air individually; and a pressing head with a nozzle for actuating the pump. The pressing head includes a cover that surrounds the hollow neck portion and that is opened at its lower side. A seal member for closing a gap the cover and the hollow neck portion in the initial position of the pressing head is provided on at least one of a lowermost end of the cover and an uppermost end of the hollow neck portion.

3 Claims, 8 Drawing Sheets

FOAM DISPENSING DEVICE

TECHNICAL FIELD

The present invention relates to a foam dispensing device which may be suitable for ejecting a face wash, a hair dressing or the like as fine foam and may be applicable to various fields such as cosmetics, toiletries, foods and the like.

RELATED ART

Some of the existing containers filled with a face wash, a hair dressing or the like are equipped with a foam dispensing device which is capable of bubbling the content only by a discharge operation, which depresses a pressing head, in order to eliminate a bubbling action and to facilitate its simple utilization.

In this type of the foam dispensing device, a piston for suctioning, pressurizing and discharging the content and a piston for suctioning, pressurizing and discharging the air are tandemly arranged and concentrically housed in a single cylinder to configure a pump, and the pump is provided in a base cap fixedly mounted on a mouth portion of the container. Each of the pistons in the pump is actuated by depressing the pressing head arranged on the base cap. With such an action, the content and the air are respectively suctioned and pressurized in the cylinder and mixed with each other in a merging space located at the outlet of the pump. The mixture is passed a bubbling member such as a mesh ring to ejecting the content to the outside in foam (see, for example, Japanese Patent Application Laid-open No. H07-315463 (JP 7-315463A)).

DISCLOSURE OF THE INVENTION

In the conventional foam dispensing device, a gap is formed between a head cover and a hollow neck portion so as to be able to perform a smooth ejecting operation without involving a contact between the head cover and the hollow neck portion and to effectively introduce the outer air into the pump for pressurizing the air. When the foam dispensing device is used in a watery place such as a bath room, it is unavoidable that the water enters into the foam dispensing device through the gap at the time of introducing the outer air.

The water having entered in the foam dispensing device accumulates in the cylinder. This may result in the decrease in the amount of the fed air which is pressurized in the cylinder, so that the mixing ratio of the air and the content may be varied. In addition, while only the air contained in the cylinder should be fed, the accumulated water is also fed, so that it is impossible to eject fine foam.

It is therefore an object of the present invention to propose a novel foam dispensing device which ensures to certainly prevent the water from entering and to introduce a sufficient amount of the outer air.

In the present invention, there is provided a foam dispensing device comprising a base cap which has a hollow neck portion standing at an upper face of a top wall and which is fixedly mounted on a mouth portion of a container in a detachable manner; a pump which is suspended from a lower face of the base cap and which has two discharge channels for suctioning, pressurizing and discharging a content in the container and the outer air individually; and a pressing head provided with a nozzle, the head actuating the pump with its pushing action and returning action after releasing the pushing force with the hollow neck portion of the base cap being as a guide to, thereby, mutually mix the content and the air discharged through said two discharging channels and eject the mixture to the outside in foam, wherein a cover which surrounds the hollow neck portion of the base cap and which is opened at its lower side is arrange on said pressing head, and a seal member for preventing the water from entering from the outside by closing a gap defined between the lowermost end of the cover and the uppermost end of the hollow neck portion in the initial position of the head is provided on at least one of a lowermost end of the cover and an uppermost end of the hollow neck portion. The seal member is held on at least one of the lowermost end of the cover and the uppermost end of the hollow neck portion, and a thin-walled elastic piece which contacts the lowermost end of the cover or the uppermost end of the hollow neck portion at its tip or either one of its upper or lower face may be attached to the seal member. As the seal member, a soft material such as an elastomer or a rubber is preferred.

At the initial position where no force is applied to the pressing head, i.e. the state in which the lowermost end of the cover of the pressing head is placed at the uppermost end of the hollow neck portion), the seal member closes the space between the uppermost end of the hollow neck portion and the lowermost end of the cover. Therefore, the water cannot enter into the dispensing device.

DESCRIPTION OF THE REFERENCE NUMERALS

Figure 1:
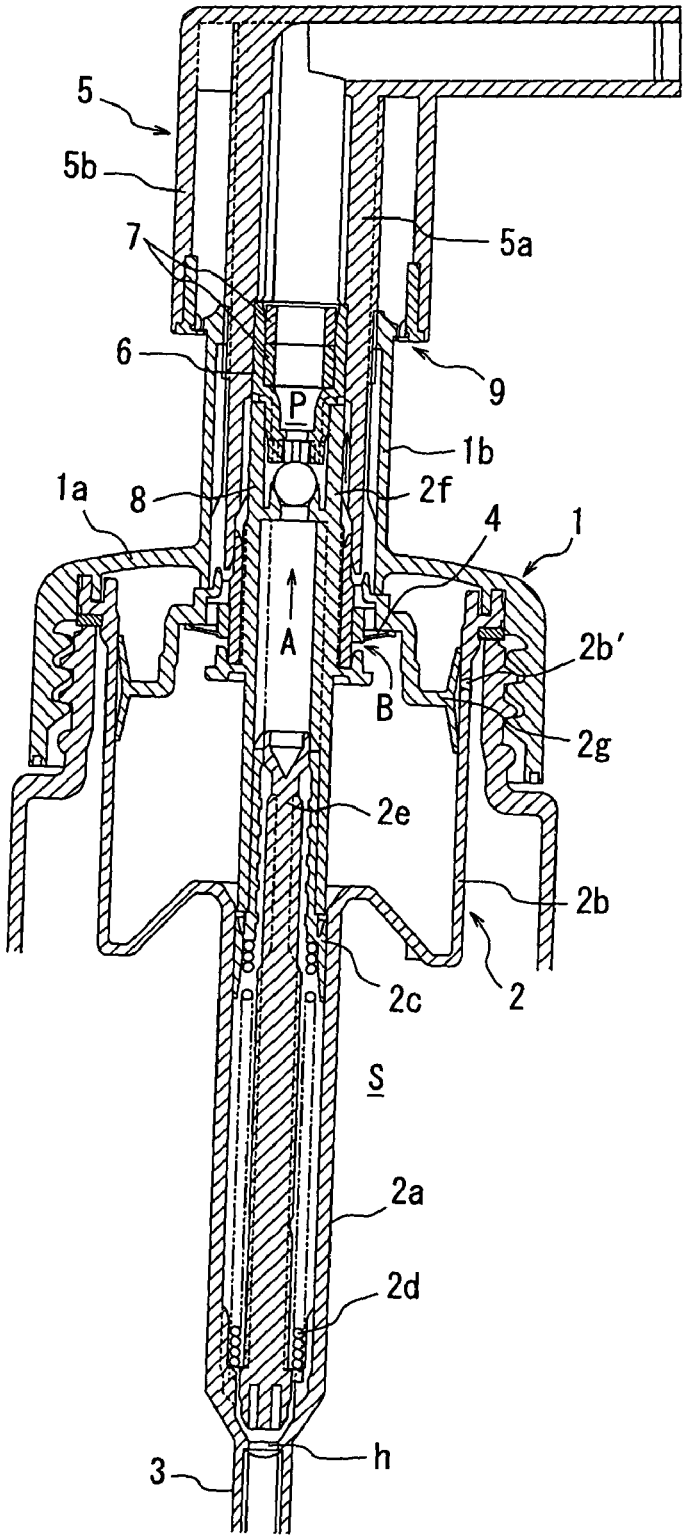
FIG. 1 shows one embodiment of a foam dispensing device according to the present invention.

1 base cap
1*a* top wall
1*a*' annular projection
1*b* hollow neck portion
2 pump
2*a* small diameter tubular portion
2*b* large diameter tubular portion
2*c* piston
2*d* spring
2*e* poppet
2*f* hollow stem
2*g* piston
3 suction pipe
4 valve
5 pressing head
5*a* hollow rod
5*b* cover
6 jet ring
7 bubbling member (mesh ring)
8 socket

9 seal member
S cylinder
A discharging channel
B discharging channel
P merging space

BEST MODE FOR CARRYING OUT THE INVENTION

With reference to the drawings, the present invention will be discussed below in detail.

FIG. 1 is a sectional view of one embodiment of a foam dispensing device according to the present invention. In the figure, the reference numeral 1 denotes a base cap which can be fixedly mounted on a mouth portion of a container with a screw or an undercut. A hollow neck portion is provided at the center of an upper face of a top wall 1*a* in the standing position.

The reference numeral 2 denotes a pump which is suspended from a lower face of the base cap 1 and which is put in the mouth portion of the container. The pump 2 consists of a single cylinder S in which a small diameter tubular portion 2*a* having an opening h coupled to a suction pipe for suctioning the content in the container and a large diameter tubular portion 2*b* connected with the small diameter tubular portion 2*a* are integrally combined.

Inside the small diameter tubular portion 2*a*, there are provided a piston 2*c* capable of sliding in the small diameter tubular portion 2*c*, a spring 2*c* elastically supporting the piston 2*c*, a poppet 2*e* having a valve body at its tip and a hollow stem 2*f* having a valve seat engaging with the valve body of the poppet 2*e* and pushing the piston 2*c* with its tip. In this way, a mechanism of suctioning, pressurizing and discharging the content is constructed.

Inside the large diameter tubular portion 2*b*, there is provided a piston 2*g* which begins to move with a slight time lag behind the start of the movement of the hollow stem 2*f* and which can slide in the large diameter tubular portion in conjunction with the movement of the hollow stem 2*f*. In this way, a mechanism of suctioning, pressurizing and discharging the air is constructed.

The content suctioned and pressurized in the small diameter tubular portion 2*a* is discharged to the outlet of the pump (the uppermost end of the hollow stem 2*f*) along the discharging channel A in the direction as indicated by an arrow in FIG. 1. Meanwhile, the air suctioned and pressurized in the large diameter tubular portion 2*b* is discharged to the outlet of the pump 2 along the discharging channel B in the direction as indicated by an arrow in FIG. 1.

The reference numeral 4 is a valve which is arranged on the piston 2*g* and opens only during the suctioning operation of the piston 2*g*. The reference numeral 5 is a pressing head having a nozzle.

In the pressing head, there is provided a channel which contacts the rear end of the hollow stem 2*f* and the rear end of the piston 2*g* to enable them to be pressed and which connect the nozzle and the hollow stem 2*f*. A hollow rod 5*a* defining a merging space P for mixing the content and the air is disposed in the channel, and a cover 5*b* which surrounds the hollow neck portion 1*b* of the base cap 1 and which is opened at its lower side is arranged outside of the hollow rod 5*a*.

Figure 2:
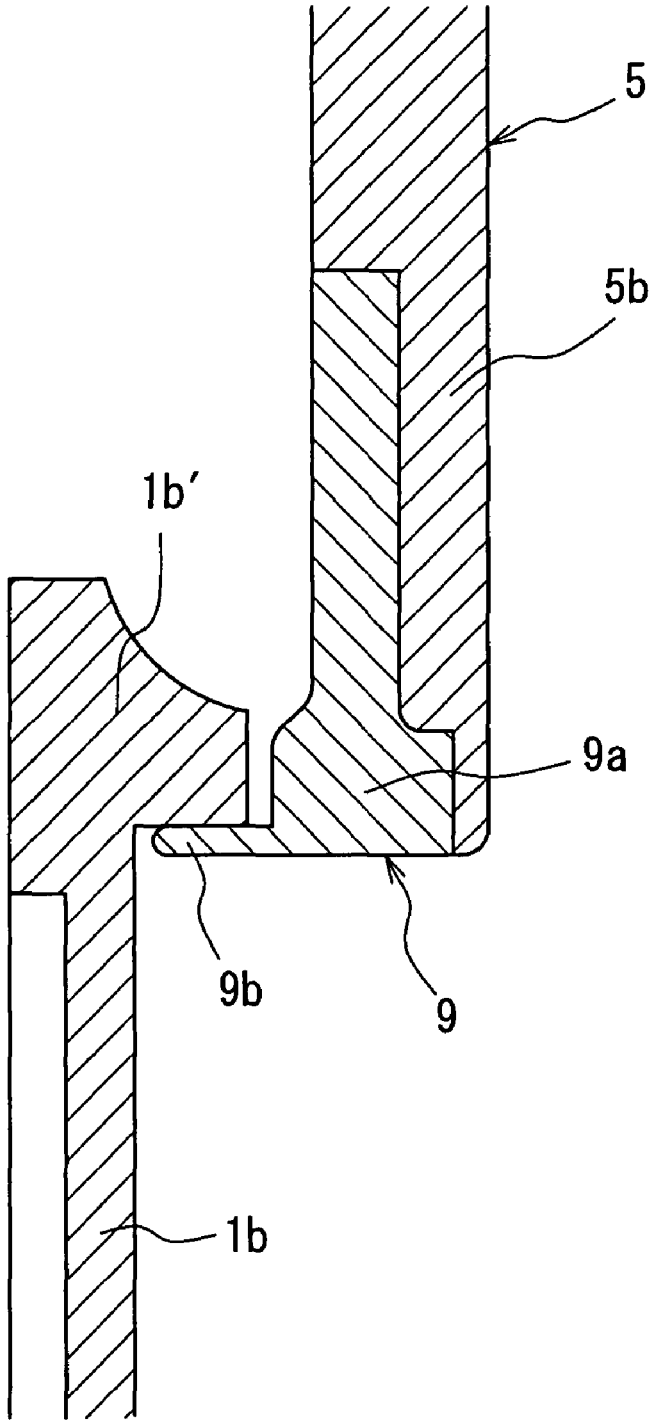
FIG. 2 is a partially enlarged view of the foam dispensing device shown in FIG. 1.

The reference numeral 6 denotes a jet ring arranged in the channel of the pressing head. The reference numeral 7 denotes a bubbling member (mesh ring) arranged next to the jet ring 6 to which a mesh for bubbling the content mixed with the air into fine foam. The reference numeral 8 denotes a socket for preventing a backflow arranged between the pump 2 and the pressing head 5. The reference numeral 9 denotes a seal member which is fitted with and held by the cover 5*b* of the pressing head 5 at the lowermost end of its inner wall face and which closes a gap formed between the lowermost end of the cover and the uppermost end of the hollow neck portion 1*b* to avoid the water invasion from the outside. As shown in FIG. 2 as an enlarged view, the seal member 9 consists of a base portion 9*a* and a thin-walled elastic piece 9*b* cantilevered by the base portion 9*a* to bring the upper face of the tip portion into contact with the lower face of an annular projection 1*b*' of the outer face of the uppermost end of the hollow neck portion 1*b*. The seal member 9 may be selected from a group made of a soft material such as PE (polyethylene resin, especially LDPE), various kinds of elastomer such as olefin-based elastomer, styrene-based elastomer and ester-based elastomer, and rubber. Among these materials, elastomer and rubber are advantageously adopted.

Figure 3:
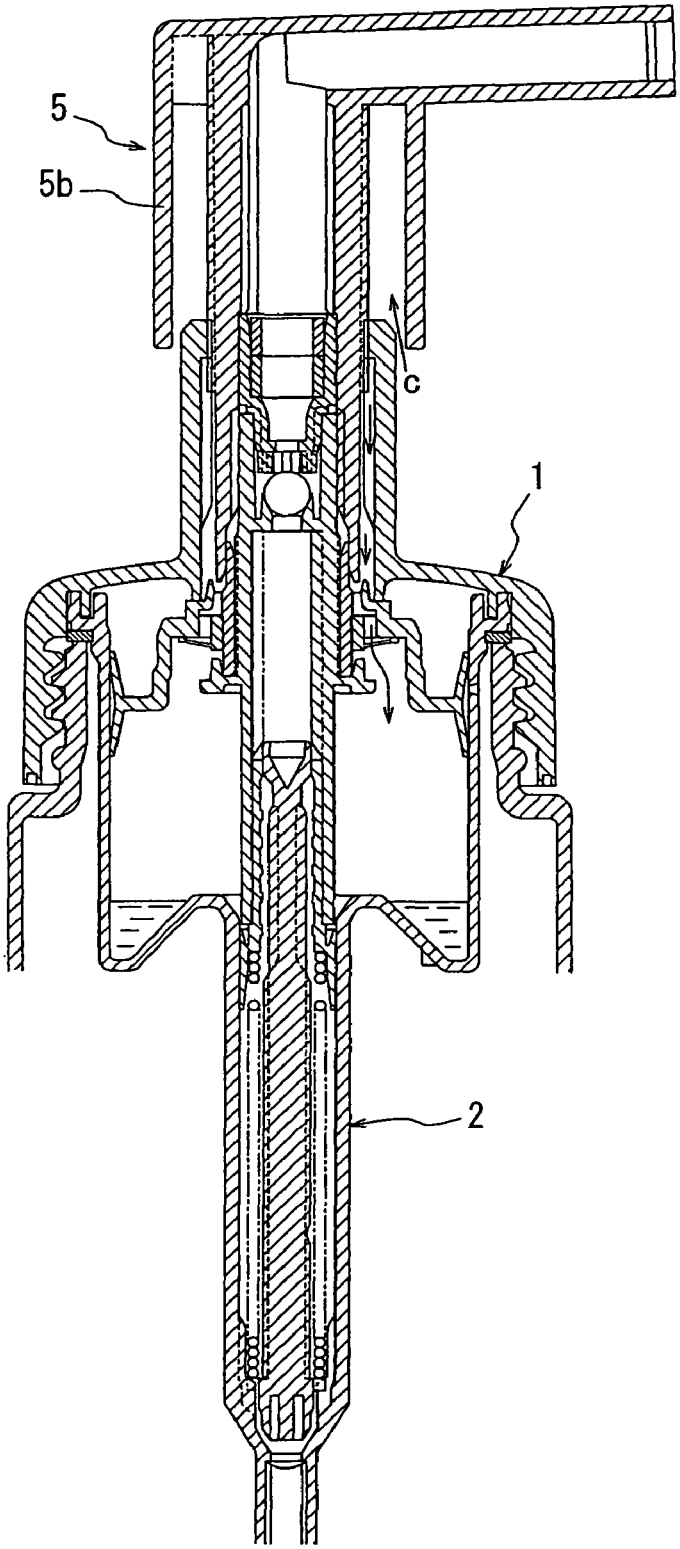
FIG. 3 Related Art
FIG. 3 shows a foam dispensing device having a generally known configuration.

FIG. 3 illustrates, by way of example, a section of a conventional foam dispensing device having an ordinal structure. The foam dispensing device with such a structure indispensably has a certain gas c between the cover 5*b* and the hollow neck portion 1*b* to prevent them from contacting with each other and to facilitate a smooth ejecting action when the pressing head 5 is depressed. Consequently, the water inevitably invades through this gap.

In contrast, according to the dispensing device of the present invention, the seal member 9 hermetically closes the space between the hollow neck portion 1*b* and the cover 5*b* when the pressing head is at the initial position, so that the water cannot easily invade from the outside.

Figure 4:
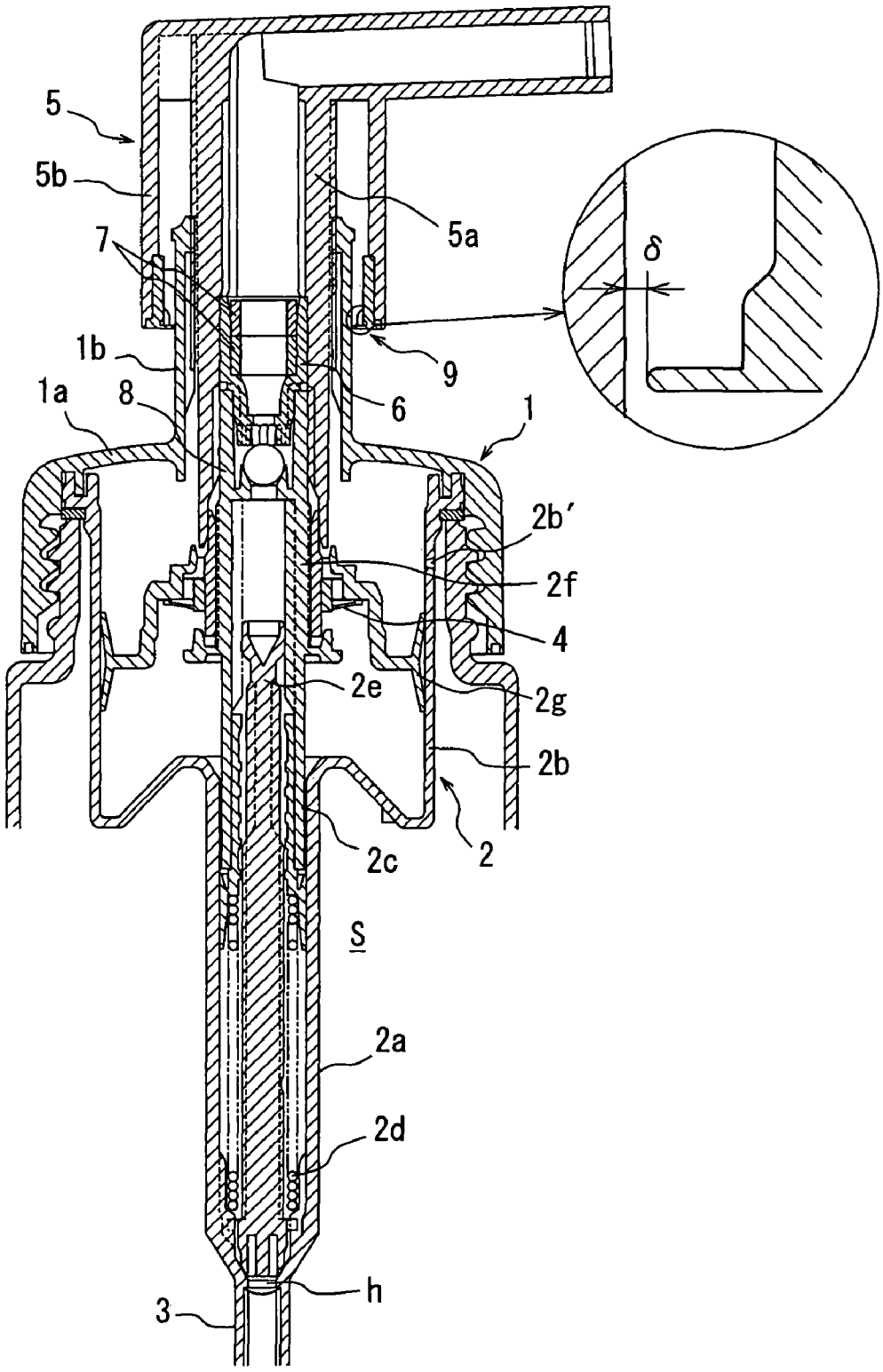
FIG. 4 shows the foam dispensing device of FIG. 1 with the pressing head being depressed.

When the content is ejected by depressing the pressing head 5, as shown in FIG. 4, a gap δ exists between the cover 5*b* and the hollow neck portion 1*b* and thus a suitable amount of the air may be stably introduced into the large diameter tubular portion 2*b* and the container.

In the state as described above and shown in FIG. 4, if the depressing force applied to the pressing head S is released, the piston 2*c*, the hollow stem 2*f*, the pressing head 5 and the piston 2*g* are respectively pushed back by the resilience force of the spring 2*d*. As a result, a negative pressure is caused in the small diameter tubular portion 2*a*, so that the content is suctioned into the small diameter tubular portion 2*a* through the suction pipe 3 and the opening h while the air is introduced in the large diameter tubular portion 2*b* through the air-intake channel.

When the pressing head 5 is depressed again after the pressing head 5 returning to the initial position as shown in FIG. 1, the lower end of the poppet 2*e* contacts the inner face of the lower portion of the small diameter tubular portion 2*a* to be sealed. Thus, the inside of the small diameter tubular portion 2*a* is pressurized and, when the it reaches a given pressure, the valve body of the poppet 2*e* is opened to discharge the content through the discharge channel A to the merging space P at the outlet side of the pump 2. In this state, the air in the large diameter tubular portion 2*b* is discharged through the discharge channel B to the merging space P as well. The mixture of the air and the content passes through the jet ring 6 and the bubbling member 7 and the foam of the content is ejected from the nozzle to the outside. With these depressing and returning actions, the foam of the content may be continuously ejected.

Figure 5:
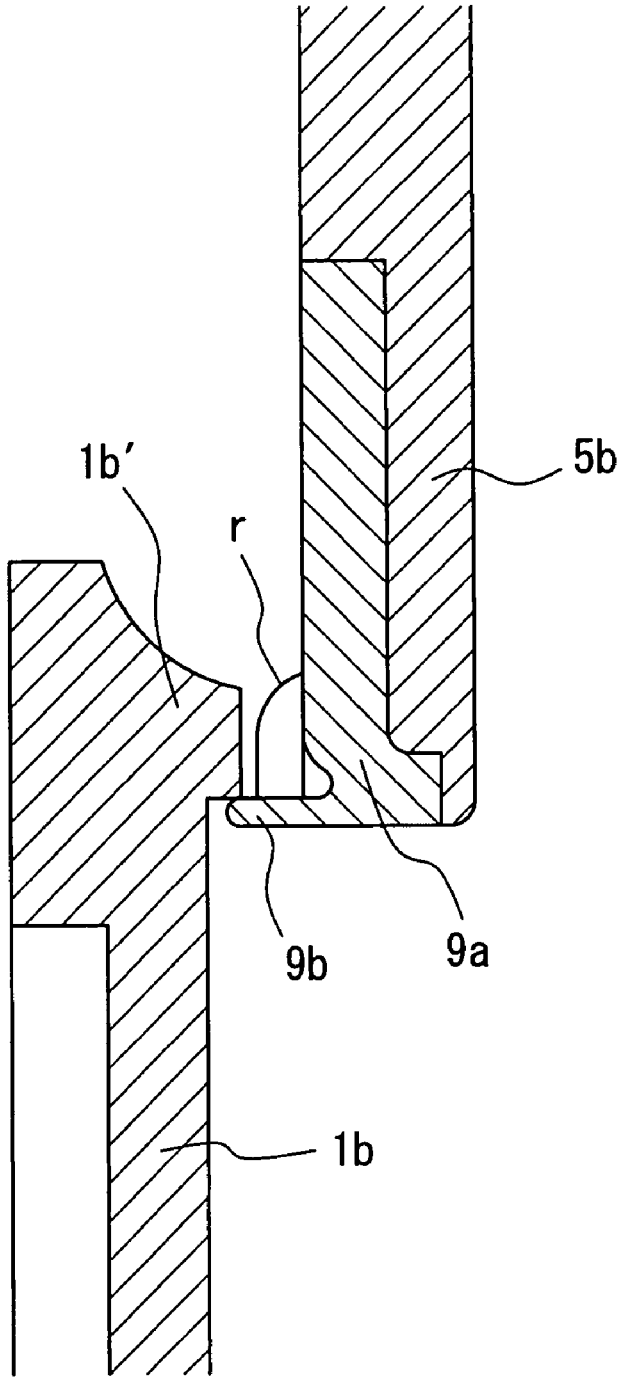
FIG. 5 shows a substantial part of another embodiment of a foam dispensing device according to the present invention.
Figure 6:
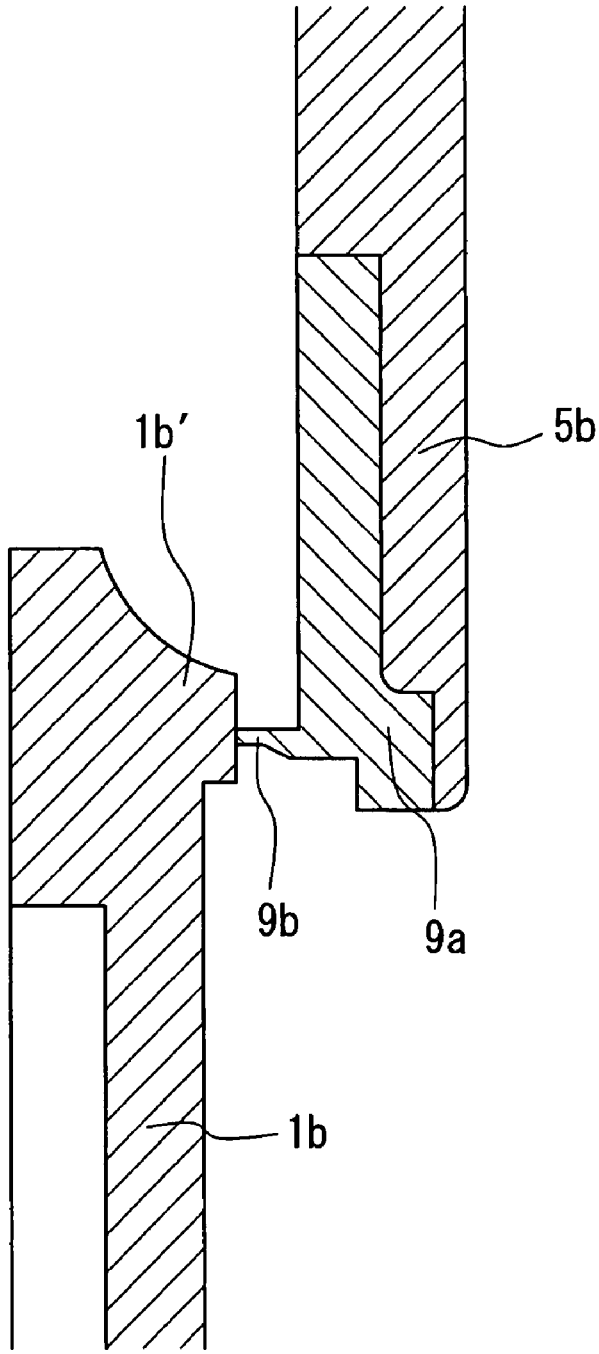
FIG. 6 shows a substantial part of another embodiment of a foam dispensing device according to the present invention.
Figure 7:
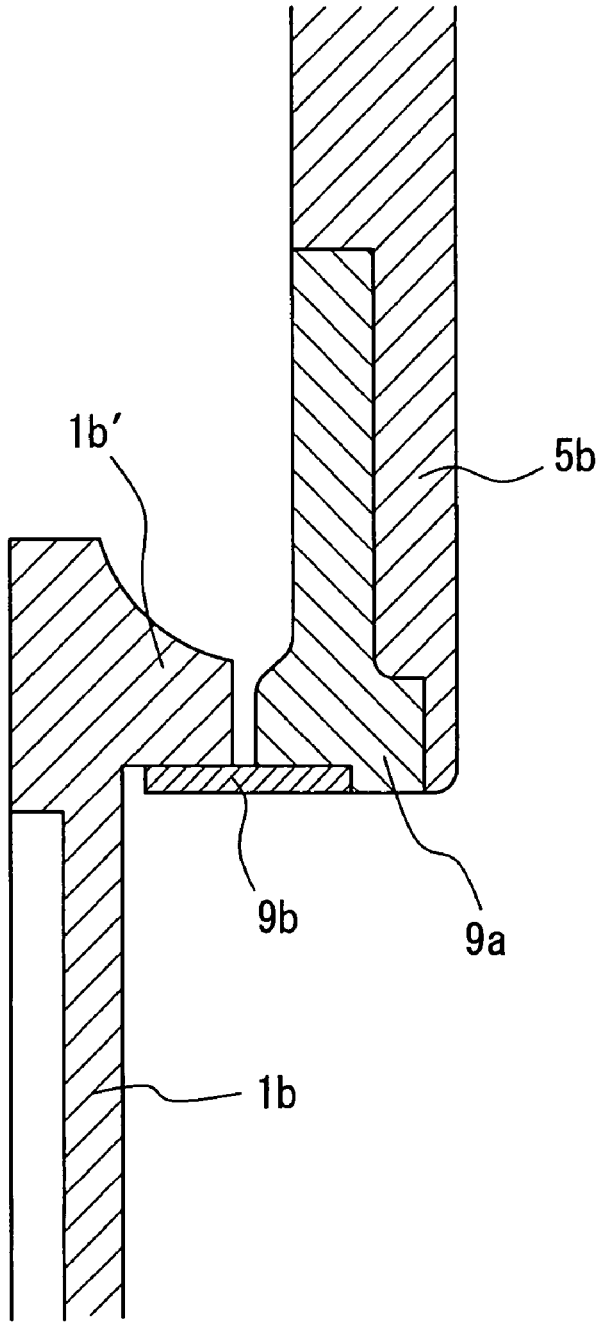
FIG. 7 shows a substantial part of another embodiment of a foam dispensing device according to the present invention.

In FIG. 2, the seal member 9 arranged at the lowermost end of the cover 5*b* is shown such that the thin-walled elastic piece 9*b* contacts the lower face of the annular projection 1*b*' provided on the outer side of the uppermost end of the hollow neck portion 1*b*, by way of example. As the seal member 9, however, adopted may be the one shown in FIG. 5 in which the elastic piece 9*b* is reinforced by the rib r, or the one shown in FIG. 6 in which the tip of the elastic piece 9*b* contacts the annular projection 1*b*' or the one shown in FIG. 7 in which the base portion 9*a* and the elastic portion 9*b* are separate members and the elastic member 9*b* is insert molded in the base portion 9*a*. If there is no particular problem in terms of the shaping and the material, the seal member may be integrally formed with the cover 5*b* and the means for fixing it may be appropriately selected from, for example, an undercut fitting, gluing and welding. In addition, employed may be a shape which is the same shape as shown in FIG. 5 except that the rib r is removed to facilitate the elastic deformation of the elastic piece 9*b*.

Figure 8:
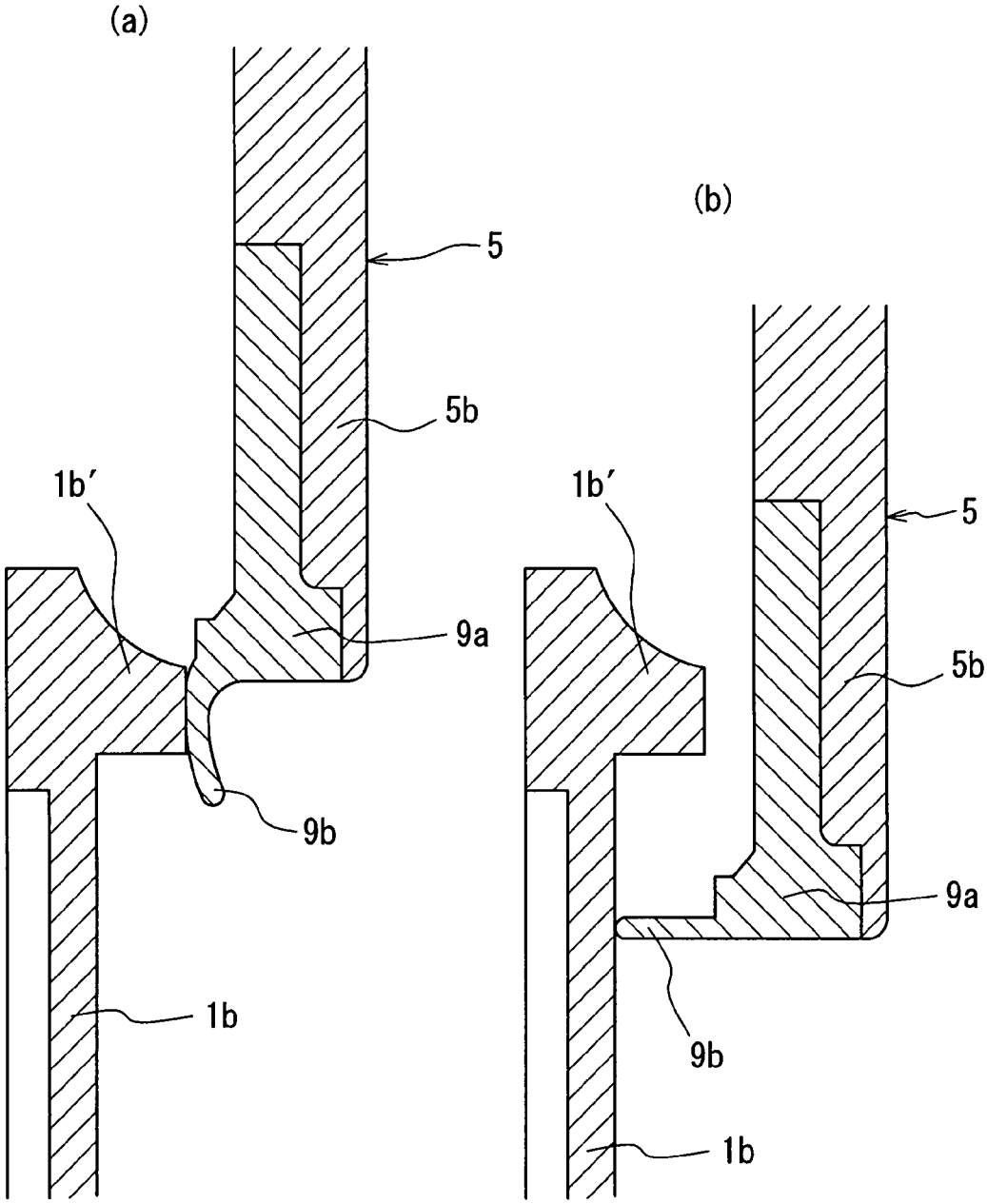
FIGS. 8(*a*) and (*b*) respectively show a substantial part of another embodiment of a foam dispensing device according to the present invention.

FIGS. 8(*a*) and 8(*b*) show a structure which brings the elastic piece 9*b* of the seal member 9 into constant contact with the hollow neck portion 1*b*, regardless the initial position and the depressed position of the pressing head 5.

The foam dispensing device having the structure shown in FIGS. 8(*a*) and 8(*b*), a seal between the cover 5*b* and the hollow neck portion 1*b* is maintained even when the pressing head 5 is depressed, so that a remarkably high sealing effect may be obtained. With such a structure, however, there is a slight concern that the introduction of the air into the large diameter tubular portion 2*b* and the container may be disturbed. To this end, the elastic piece 9*b* is readily elastically deformed to enable an introduction of the air from the outside when the pressing head 5 is depressed or recovered.

As an alternative to the above-described examples, adopted may be a structure in which the seal member 9 fittingly held by the cover 5*b* of the pressing head 5 at the lowermost end of the inner wall face is arranged on the outer side of the uppermost end of the hollow neck portion 1*b* to form the annular projection on the lowermost end of the inner wall face of the cover 5*b*, or a structure in which the seal members of soft material are arranged on both of the cover 5*b* and the hollow neck portion 1*b*, although they are not shown in the figures.

Further, the shape of the seal member 9 is not limited to the above-described examples as far as it can close the gap and is elastically deformable.

INDUSTRIAL APPLICABILITY

According to the present invention, it is possible to provide a foam dispensing device which can prevent the water invasion from between a cover and a hollow neck portion of a base cap.

The invention claimed is:

1. A foam dispensing device, comprising:

a base cap which has a hollow neck portion standing at an upper face of a top wall and which is fixedly mounted on a mouth portion of a container in a detachable manner;

a pump which is suspended from a lower face of the base cap and which has two discharge channels for suctioning, pressurizing and discharging a content in the container and outer air individually; and a pressing head provided with a nozzle, the pressing head actuating the pump with pushing action of the pressing head and a returning action after releasing a pushing force with the hollow neck portion of the base cap being used as a guide to, thereby, mutually mix the content and the outer air discharged through the two discharge channels and eject the mixture to outside in foam, wherein a cover which surrounds the hollow neck portion of the base cap and which is opened at its lower side is arranged on the pressing head, a separate seal member is provided on a lowermost end of the cover, the separate seal member sealing a gap between the lowermost end of the cover and an uppermost end of the hollow neck portion when the pressing head is in an unpushed position, the separate seal member includes a base portion and a thin-walled elastic piece cantilevered by the base portion, the thin-walled elastic piece having a distal tip and a tip portion between the distal tip and the base portion, the tip portion having an upper face and a lower face, and one of the distal tip, the upper face of the tip portion or the lower face of the tip portion contacts the hollow neck portion, thereby sealing the gap.

2. The foam dispensing device according to claim 1, wherein the separate seal member is made of a soft material such as an elastomer or a rubber.

3. The foam dispensing device according to claim 1, wherein when the pressing head is subjected to a pushing action, the gap between the lowermost end of the cover and the uppermost end of the hollow neck portion is unsealed.

* * * * *